US009890639B2

(12) United States Patent
Broatch

(10) Patent No.: US 9,890,639 B2
(45) Date of Patent: Feb. 13, 2018

(54) ROTARY MACHINE

(71) Applicant: Peter Broatch, Weymouth Dorset (GB)

(72) Inventor: Peter Broatch, Weymouth Dorset (GB)

( * ) Notice: Subject to any disclaimer, the term of this patent is extended or adjusted under 35 U.S.C. 154(b) by 158 days.

(21) Appl. No.: 14/647,441

(22) PCT Filed: Jan. 7, 2014

(86) PCT No.: PCT/GB2014/050035
§ 371 (c)(1),
(2) Date: May 26, 2015

(87) PCT Pub. No.: WO2014/083364
PCT Pub. Date: Jun. 5, 2014

(65) Prior Publication Data

US 2015/0315913 A1 Nov. 5, 2015

(30) Foreign Application Priority Data

Nov. 30, 2012 (GB) ..... 1221563.8
Nov. 29, 2013 (GB) ..... 1321080.2

(51) Int. Cl.
*F02B 53/04* (2006.01)
*F02B 53/00* (2006.01)
(Continued)

(52) U.S. Cl.
CPC ..... *F01C 19/08* (2013.01); *F01C 1/103* (2013.01); *F01C 1/104* (2013.01); *F01C 21/06* (2013.01); *F01C 21/18* (2013.01); *F02B 53/00* (2013.01); *F04C 2/103* (2013.01); *F04C 15/0023* (2013.01); *F04C 15/0096* (2013.01); *F04C 15/06* (2013.01); *F04C 18/10* (2013.01); *F04C 27/005* (2013.01); *F04C 29/04* (2013.01); *F04C 29/12* (2013.01); *F04C 2240/603* (2013.01)

(58) Field of Classification Search
CPC ..... F01C 19/08; F01C 1/103; F01C 21/18; F04C 15/06; F04C 2240/603; F04C 18/10; F04C 27/005; F04C 2/103
USPC ..... 418/104, 125, 127, 128, 129
See application file for complete search history.

(56) References Cited

U.S. PATENT DOCUMENTS 3,288,121 A 3/1966 Linder
3,340,853 A * 9/1967 Link ..... F02B 53/00 123/210
3,917,437 A * 11/1975 Link ..... F01C 1/104 418/125

FOREIGN PATENT DOCUMENTS

DE 1551128 2/1970
DE 2916858 11/1980
(Continued)

OTHER PUBLICATIONS

PCT International Search Report, dated Feb. 26, 2015.

*Primary Examiner* — Mark Laurenzi
*Assistant Examiner* — Anthony Ayala Delgado
(74) *Attorney, Agent, or Firm* — Bradley D. Crose; Crose Law LLC

(57) ABSTRACT

A rotary fluid machine has an inner rotor and an outer shell held by a stationary support structure, arranged so that sealing points on the inside of the shell interact in a sealing arrangement with the outer surface of the rotor to define working chambers, such that in use the relative motion of the rotor to the shell causes fluid to be moved through ducts in the rotor and rotor shaft, between the working chambers and a point where the rotor shaft interacts with the support structure.

20 Claims, 6 Drawing Sheets

(51) Int. Cl.

| | |
|---|---|
| ***F01C 19/08*** | (2006.01) |
| ***F04C 2/10*** | (2006.01) |
| ***F04C 18/10*** | (2006.01) |
| ***F04C 15/00*** | (2006.01) |
| ***F04C 27/00*** | (2006.01) |
| ***F04C 29/12*** | (2006.01) |
| ***F04C 15/06*** | (2006.01) |
| ***F01C 21/06*** | (2006.01) |
| ***F04C 29/04*** | (2006.01) |
| ***F01C 21/18*** | (2006.01) |
| ***F01C 1/10*** | (2006.01) |

(56) References Cited

FOREIGN PATENT DOCUMENTS

| | | |
|---|---|---|
| DE | 3209807 | 2/1983 |
| FR | 1124310 | 10/1956 |
| GB | 764719 | 1/1957 |
| WO | 2014083364 | 6/2014 |

* cited by examiner

ROTARY MACHINE

BACKGROUND OF THE INVENTION

Many different kinds of rotary engines and compressors are known. It has long been the goal to replace reciprocating compressors and engines with rotary machines, however certainly in the case of engines, very few have become successful and widely used today.

In the field of rotary engines, the design which has had most development and use is the well-known Wankel engine. However this suffers from a number of problems, one of which is wear issues with the internal rotor seals, and another is that it is not a true rotary machine, in that there are still eccentrically moving parts which generally requires there to be two counterbalanced rotors, or use made of rotating counterweights. Furthermore, the location of the tip seals on the inner rotor means that these cannot be replaced without stripping the entire engine down.

It is possible to use a Wankel design and to spin both the inner rotor and the outer casing axially, thus having no eccentric components, as in the very first version, the DKM engine. However with this design the sealing points are on the inner rotor, which means that the sliding surface containing the inlet and exhaust ports must be in the shell or casing. This means that the ports and ducts which the sealing points sweep past to control the fluid transfer must be located in the shell. It is difficult to make the sealing arrangements necessary to get the gases from the ducts on the rotating shell to the outside of the engine.

Various designs of rotary engines and compressors have been disclosed, which have two rotors spinning on offset parallel axes. Examples of these are GB764719, DE2916858, FR1124310 and DE3209807. Taking first GB764719, this design discloses ducts to transfer fluid to and from the working chambers, with the ducts located within a shaft of the machine. However the ducts extend from the working chambers through the rotor, and then into the substantially stationary shaft, which requires a sealing arrangement between these two components. In this arrangement the control of the fluid to and from the working chambers is by means of the rotor rotating about this shaft, meaning that this machine requires seals both to create the working chambers (the spaces between the inner and outer rotors) and seals to control the flow of fluid to/from the working chambers. In addition, the ports and ducts in the inner rotor are bidirectional which can slow the fluid progress, and they are also permanently connected to the working chambers thus increasing the effective chamber volume and reducing the possible compression ration of the machine. The other documents mentioned here, DE2916858, FR1124310 and DE3209807, are all similar with regards to the transfer of fluid to the working chambers.

Cooley proposed an engine (U.S. Pat. No. 724,994) very similar to the invention here, using two axially spinning rotors. In his design the inlet and outlet routes were via sliding seals between the shell and the casing which would make this design problematic and prone to leakage.

Many other rotary engine designs disclose methods of getting the gases into and out of the working chambers, however most have relatively complex ducts containing several moving parts, which causes problems with sealing and heat transfer from hot exhaust gases.

It is the aim of this invention to overcome some of the problems that previously known rotary machines suffer from, that is the difficulty of getting the gases or working fluids into and out of the working chambers from the outside of the machine, the balancing and mechanical problems of eccentric and reciprocating components, seal replacement, insulation of hot gases from component parts and these other designs' general overall complexity.

SUMMARY OF THE INVENTION

This invention concerns a rotary machine designed to be used as an engine or a compressor. More specifically, it concerns a machine where the sliding sealing points are located in the outer casing or shell, and the surface which the sealing points slide against forms part of the central rotor, causing the fluid to be transferred via one or more ports on the inner rotor. Thus the control of the fluid to and from the working chambers located between the rotor and the shell is by means of these sealing points moving across the ports, and at least one of these ports is connected to a duct in the rotor and rotor shaft which duct is made continuous and unitary with the port and is extended to the outside of the machine. In this way the duct is unidirectional, meaning that the duct is always either transferring fluid into the working chambers, or out of the working chambers, depending on the direction of rotation of the machine.

A principal advantage of this arrangement is that the fluid can be transferred between the port and the outside of the machine via a simple duct in the rotor and shaft without the complication of additional control measures, seals or additional moving parts. This enables both the rotor and shell to spin axially so making a true rotary machine. In instances when this machine is used with hot gases, for instance as an internal combustion engine, the simple rotary nature of the rotor shaft, and the duct it encompasses, around a stationary axis, means that sealing to a further duct or pipe is easy to achieve with a concentric rotary seal, and in addition it is easy to insulate the duct against heat transfer into engine components.

Another advantage is that the sealing points can be accessed from outside the machine enabling easy replacement and opening up the possibility of using cheaper or faster wearing materials.

It may be seen that there are several advantages in providing the fluid control means directly adjacent to the port and duct, including that the duct is unidirectional and therefore the fluid flow can be continuous in one direction rather than oscillating back and forth, and that the volume of the duct does not become part of the working chamber, which would reduce the maximum compression of the machine.

Thus according to the invention there is a rotary machine comprising:

- an inner rotor and an outer shell,
- the rotor rotating on a first axis and the shell rotating on a second axis parallel to and offset from the first axis,
- an external support structure which holds the first and second axes in alignment to each other, and wherein the said axes are substantially stationary relative to the support structure,
- the shell having two or more sealing points on its inner surface which interact with the outer surface of the rotor to define two or more working chambers between the rotor and the shell,
- said outer surface including a fluid transfer port,
- a shaft attached to the rotor and concentric with the first axis of rotation, the shaft containing a duct substantially parallel to the first axis of rotation, which duct is connected to a further duct in the rotor and said further duct connected to the port, the duct and further duct together forming a continuous passageway for fluid from the port to a point where the shaft interacts with the support structure, wherein the passageway is continuously open and substantially unobstructed and rotates about an axis which is substantially stationary relative to the support structure, such that in use the relative rotation of the rotor to the shell causes the working chambers to change in size, and whereby the relative movement of the sealing points across the port controls the transfer of fluid between the port and the working chambers, and wherein for a given direction of rotation of the rotor the fluid is transferred unidirectionally through the passageway between the working chambers and the point where the shaft interacts with the support structure The rotor preferably has an outer surface substantially parallel to the axis of rotation of the rotor, and the shell preferably has an inner surface substantially parallel to the axis of rotation of the shell The outer surface of the inner rotor is preferably substantially in the form of an epitrochoid with one or more lobes, however other suitable shapes may be used for the outer surface of the rotor, providing of course that in use the sealing points of the shell maintain contact or very close proximity to the surface of the rotor. Preferably the inside surface of the shell is also substantially epitrochoidal in shape.

The rotor shaft may be attached to one side of the rotor, or it may extend right through the rotor from one side to the other. In another arrangement two shafts may be used, one on either side of the rotor.

The rotor and shell are preferably mounted in a frame, structure or casing to locate the axes of the shell and rotor accurately in relation to each other.

The rotor surface may typically have two lobes and the shell have three sealing points, but other arrangements are possible for instance a rotor with three lobes and a shell with four sealing points. Many other combinations are possible generally using a rotor with one less lobe than there are sealing points on the shell.

The rotor may comprise a second port, second duct, and second further duct wherein the second duct is preferably located in the opposite end of the shaft to the first duct so that in use fluid will enter the machine at one end of the rotor shaft and exit at the other.

Alternatively the rotor may have a second fluid transfer port which connects to a void within the rotor, which further connects to the outside of the machine via a duct within the shell, such that in use the fluid will enter the machine through the shell shaft and exit through the rotor shaft, or fluid will enter through the rotor shaft and exit through the shell shaft.

The duct in the rotor shaft may connect to a stationary duct, pipe or manifold attached to the exterior of the machine via a rotary seal.

The duct and further duct forming the passageway may be made to be unitary, that is to be of one piece and not composed of separately moving parts.

The shell preferably includes an internal gear wheel, which meshes with an outer gear wheel attached to the rotor so as to keep these two parts moving in correct relationship with each other and therefore minimising internal wear of the sealing points and surfaces.

The sealing points may be comprised movable strips, which may conveniently be accessed from the outside of the shell, enabling their easy replacement.

With a design using a two lobed rotor, there are preferably provided one inlet port and one outlet port at suitable locations on the rotor to enable the machine to operate as a four stroke internal combustion engine, or alternatively a similar two lobed design may be used as a pump or compressor by providing two inlet ports and two outlet ports at suitable locations on the rotor.

When the machine is being used as an engine, spark plugs may be provided around the periphery of the shell. There may be provided means to add fuel to and regulate the air flow into the engine, e.g. an injection system or carburettor which may conveniently be attached to the frame holding the rotor and shell, and the outlet fluid transfer port and ducts may be connected to an exhaust system.

When in use as an engine the exhaust gases preferably exit the machine via the passageway in the rotor shaft. The inside surface the passageway may be provided with thermal insulation to prevent the hot exhaust gases from heating the rotor and/or shaft excessively. The unitary nature of the passageway facilitates the provision of this insulation.

DETAILED DESCRIPTION

The invention will now be described, by way of example only, with reference to the accompanying drawings.

Figure 1:
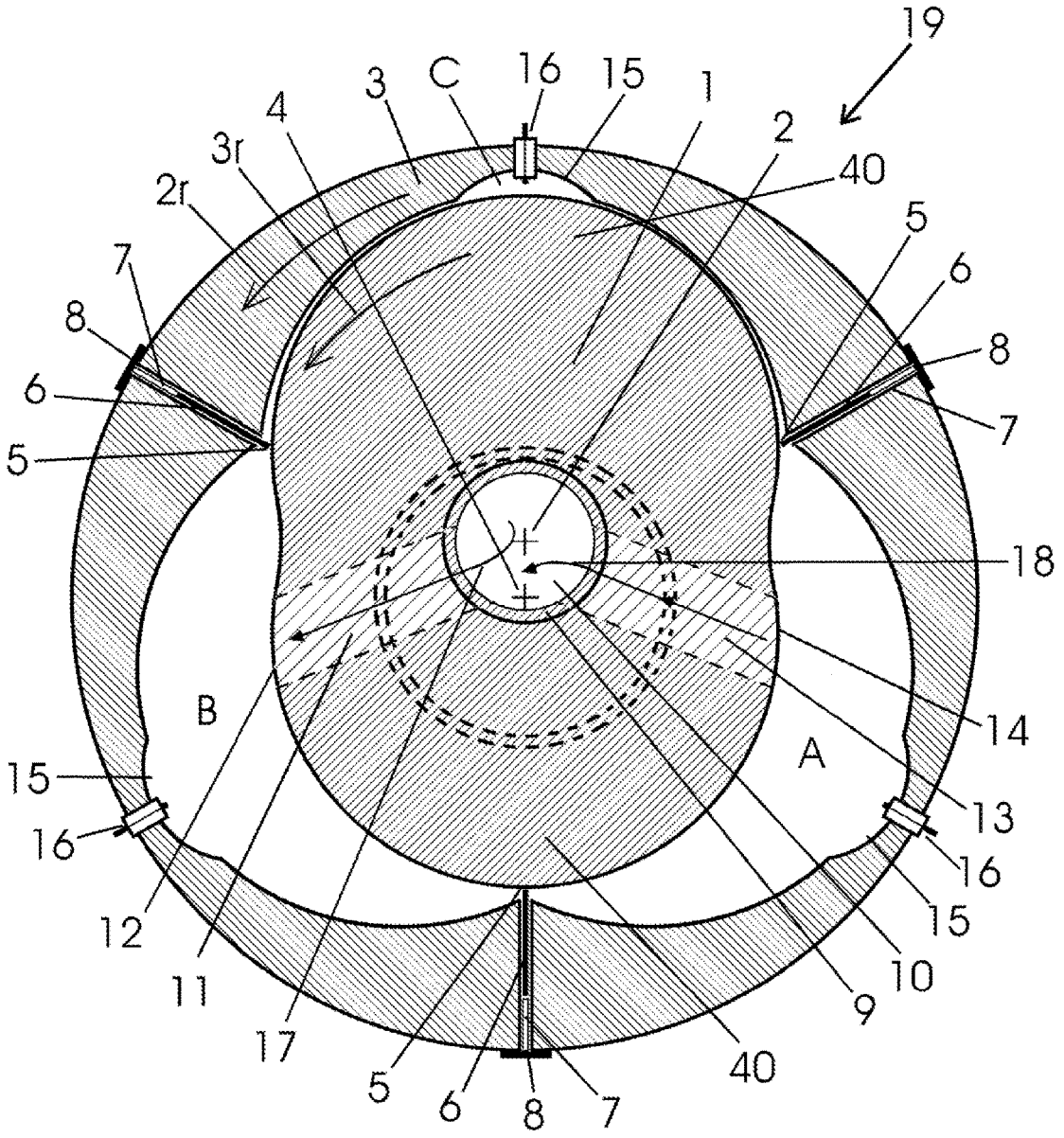
FIG. 1 shows a cross section of components of an engine perpendicular to the axes of rotation

Referring first to FIG. 1, this shows the main moving components 19 of a four stroke internal combustion engine according to the invention, for ease of viewing shown without the structure which holds these components in place. In this engine an inner rotor 1 rotates around an axis 2 within an outer shell 3 which rotates around an axis 4 offset from axis 2, the direction of rotation being by the arrows 2*r* and 3*r*. The rotor in this embodiment has two lobes 40 and the shell has three sealing points 5. The sealing points are comprised moveable sealing strips 6 with spring arrangements 7 and retaining plates 8. Both the shell 3 and the rotor 1 rotate in the same direction at different speeds in the ratio 2:3 respectively. Due to the epitrochoidal geometry of the rotor surface and the relative speeds of the rotor and shell, the sealing points maintain a sliding gas tight seal with the rotor surface. The rotor shaft 9 is cylindrical and encompasses a duct 10 in the centre. The duct in the rotor shaft nearest the observer extends to a further duct 11 through the rotor terminating at a port 12 (inlet port) in the external surface of the rotor, this duct, further duct and port forming a passageway 17. A duct in the shaft which is furthest from the observer (not shown) extends to a duct 13 through the rotor and terminates at the port 14 (outlet port). This second duct, second further duct and second port forms a second passageway 18. Three working chambers A, B, C are formed by the interaction of the sealing points in the shell and the rotor surface. One skilled in the art will see that in use the rotation of the rotor and the shell causes the working chambers to vary in size, which in conjunction with the position of the inlet and outlet ports causes gas to be drawn in, compressed, combusted and expanded and then expelled as in a standard four stroke engine. In this diagram the chamber A between the rotor and the shell is in the process of expelling gas through the outlet port 14, the direction of flow shown by the arrow, and chamber B is drawing in gas through the inlet port 12, again the gas flow is shown by the arrow. Chamber C is at the fully compressed position for firing. The outer shell may include one or more combustion cavities 15 to hold the bulk of the compressed gas. Spark plugs 16 ignite the compressed gases at the point of maximum compression.

Figure 2:
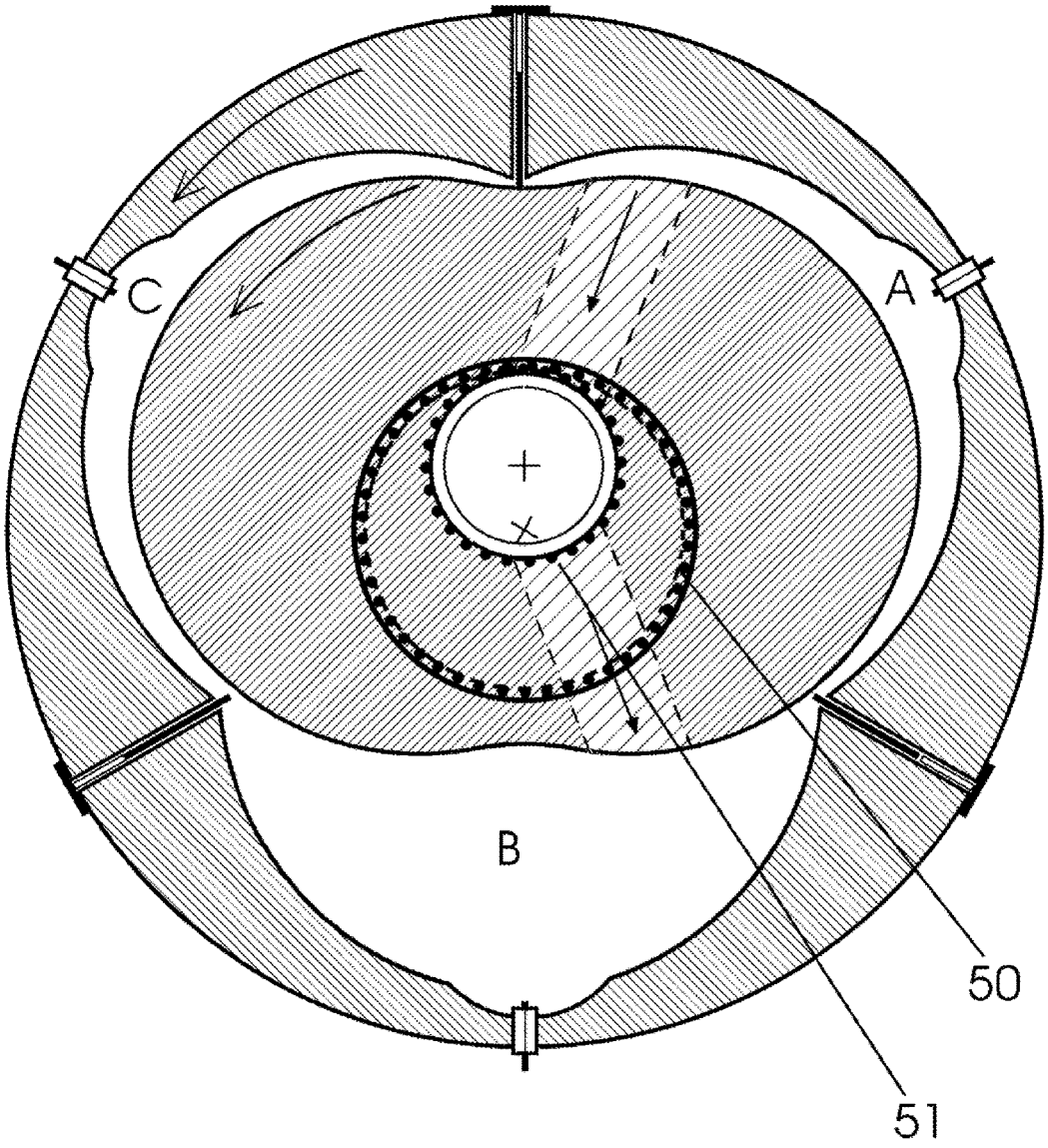
FIG. 2 shows the engine components as in FIG. 1, after an anticlockwise rotation of the rotor of 90 degrees

FIG. 2 shows the rotor and shell as in FIG. 1 after the rotor has passed through 90 degrees of anticlockwise rotation, with a corresponding 60 degrees of rotation of the shell. Chamber A has decreased in volume, B has reached maximum volume and C is just starting to expand. Thus it can be seen that the rotation causes gas flow compatible with a four stroke engine cycle.

Note the location of the two meshing gear wheels on the shell 50 and the rotor 51. These gears ensure that the rotor moves in the correct relationship to the shell, preventing contact between the rotor surface and the shell surface (except at the sealing points) and reducing the stress and wear to the shell, sealing points and rotor surface.

Figure 3:
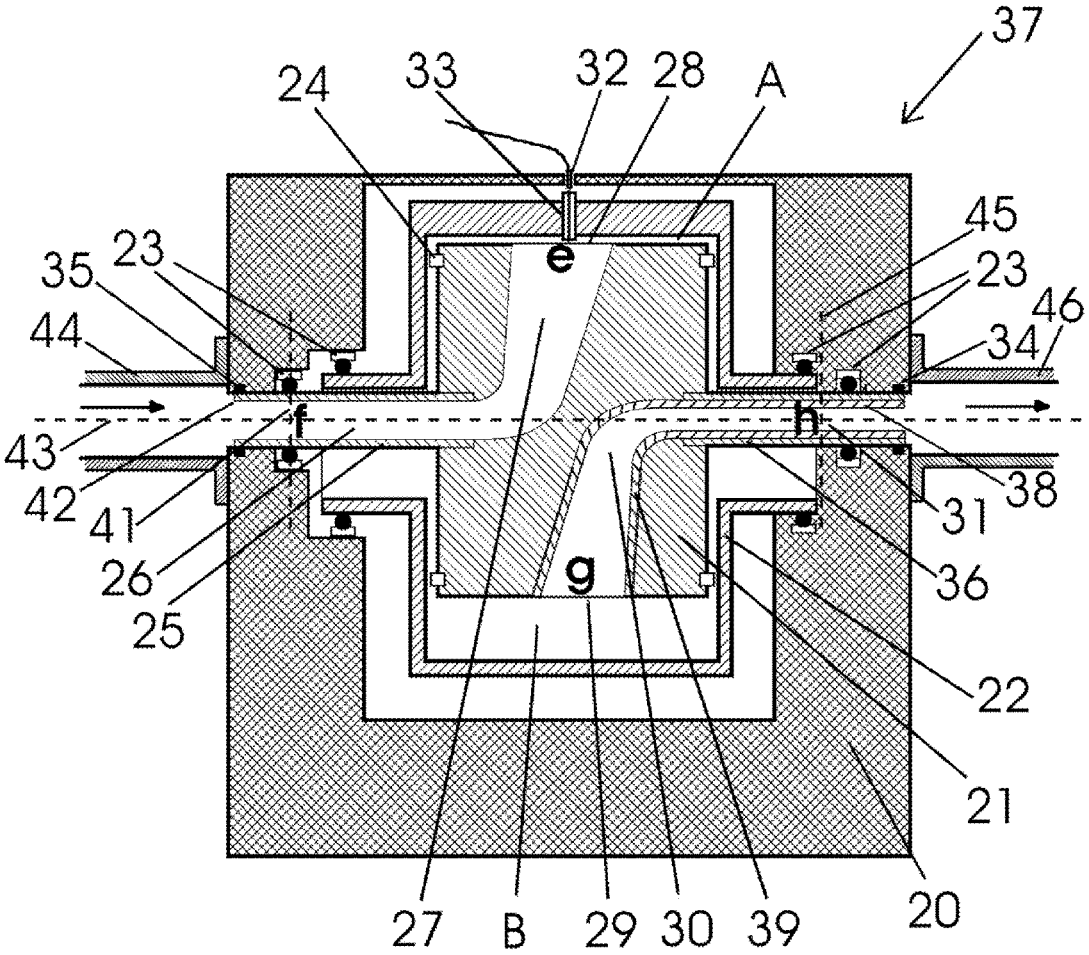
FIG. 3 shows a cross section of the engine in FIG. 2 in line with the axes of rotation

FIG. 3 shows a cross section in line with the axes of rotation of an engine 37 with the same relative position of rotor and shell as in FIG. 2, and including additional components not shown in FIG. 2. A support structure 20 locates the rotor 21 and the shell 22 in position by means of bearings 23. The rotor is equipped with side seals around its periphery 24 which seal against the inside of the shell 22 (the sealing points of the shell are not shown in this diagram). A port in the rotor 28 is connected to the duct 27 in the rotor, which extends to the duct 26 in the shaft 25 and which is parallel to and concentric with the axis of rotation 43 of the shaft and the rotor. The duct 26 extends to a point 41 where the shaft interacts with the support structure via a bearing 23, this arrangement of ducts comprising a passageway e-f for the transfer of fluid between the working chamber A and the point 41. It may be seen that the passageway is unitary, in that it is bounded by parts joined together, and not made of parts moving relative to each other. The shaft 25 and a continuation of the duct 26 within it extend beyond the point 41 to where the shaft terminates at 42. A rotary seal 35 seals the shaft to the support structure allowing the duct to further extend to a stationary duct 44 attached to the support structure. It may be seen that at points beyond 41 towards 42 the shaft with its integral duct is rotating on a stationary axis 43 in relation to, and is adjacent to, the support structure, which means that from point 41 onwards away from the rotor the transfer of gases to or from the engine may be easily arranged.

A second port 29 is connected to duct 30 in the rotor and duct 31 in the shaft 36, this arrangement comprising a second passageway for the transfer of fluid between chamber B and the point 45 where the shaft 36 interacts with the support structure, in this case through being in close proximity to it. The shaft extends beyond point 45 and the duct is sealed against the support structure with the seal 34.

Thermal insulation 38 is fitted to the shaft 36 to protect it from the hot exhaust gases. Additional insulation 39 is fitted to the duct 30 in the rotor. It may be seen that as the ducts forming the passageway g-h are unitary and move together it makes the installation of this insulation around the passageway much easier to achieve.

A high voltage electrical current is supplied to an electrode 32 which is in close proximity to the spark plug 33 at the point when the engine is at the position of maximum compression, thus initiating combustion.

Figure 4:
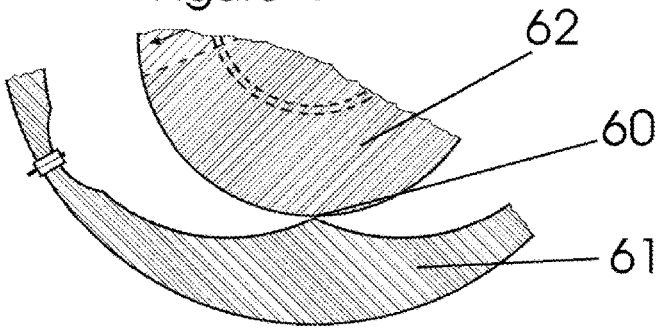
FIG. 4 shows a modification of the sealing points

FIG. 4 shows a variation of the sealing points of the embodiment in FIG. 1, in which the sealing points 60 are contiguous with the shell 61 and achieve the gas tight sealing by being maintained in very close proximity to the rotor 62.

Figure 5:
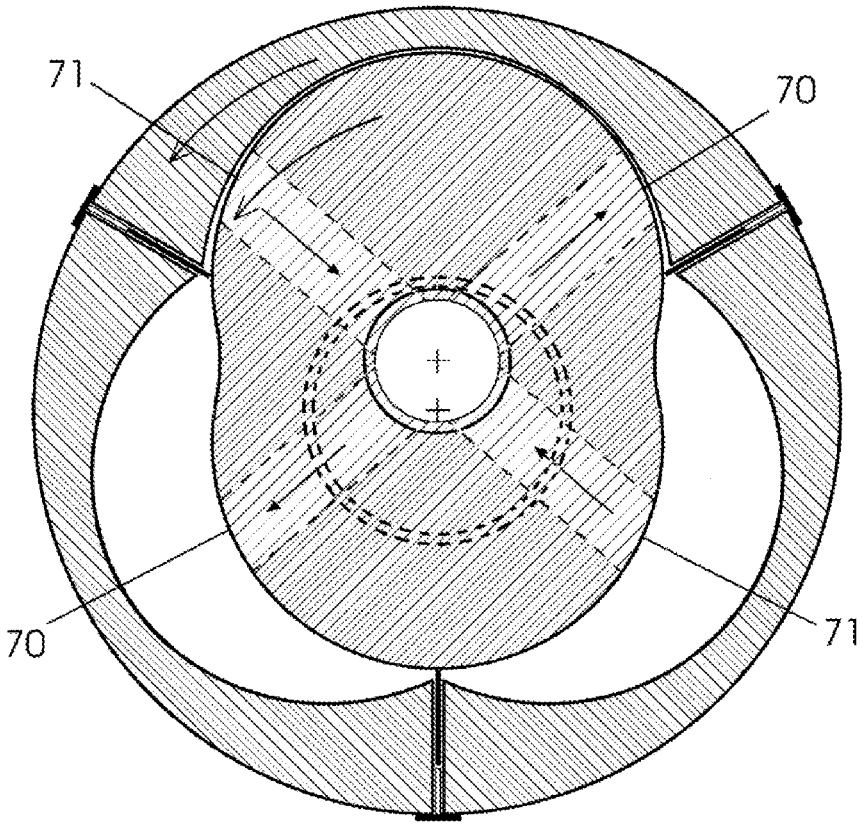
FIG. 5 shows a compressor with four ports

FIG. 5 shows a compressor which has two inlet ports 70 and two outlet ports 71. This uses the same principal of variable size chambers as the engine in FIG. 1, but omits the combustion/expansion cycle and instead performs two compression cycles for every 360 degree rotation of the rotor.

Figure 6:
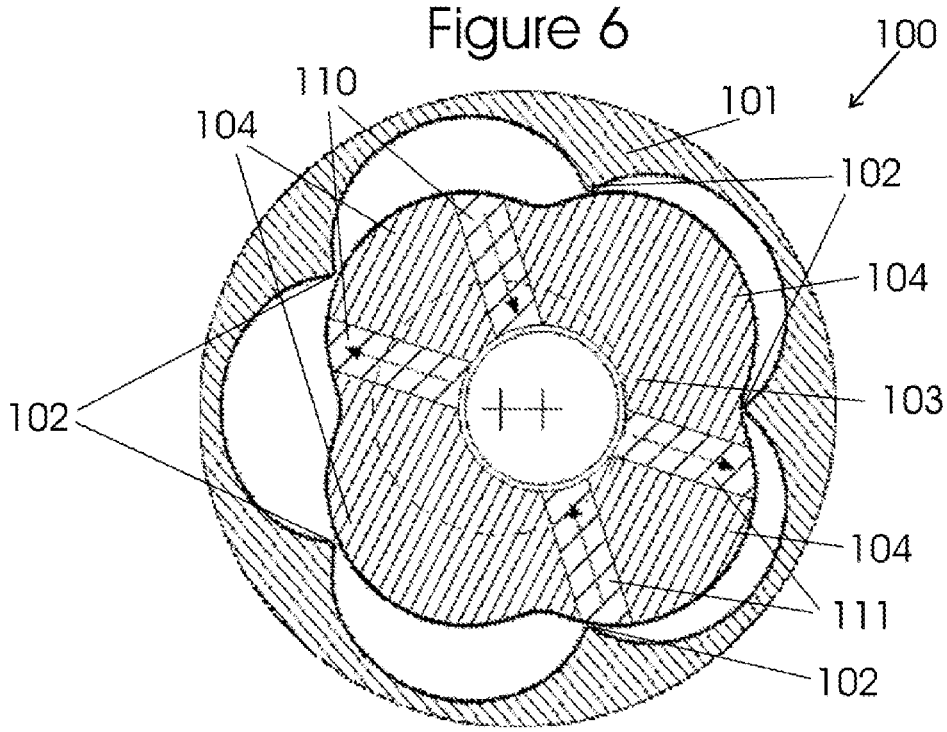
FIG. 6 shows an engine comprising a rotor with four lobes and a shell with five sealing points

FIG. 6 shows an engine 100 comprising a shell 101 with five sealing points 102, and a rotor 103 with four lobes 104. In this arrangement it is necessary to have two pairs of ports 110, 111. It may be seen that this arrangement creates a well-balanced rotor both mechanically and in terms of thermal expansion due to the symmetrical arrangement of the rotor.

Figure 7:
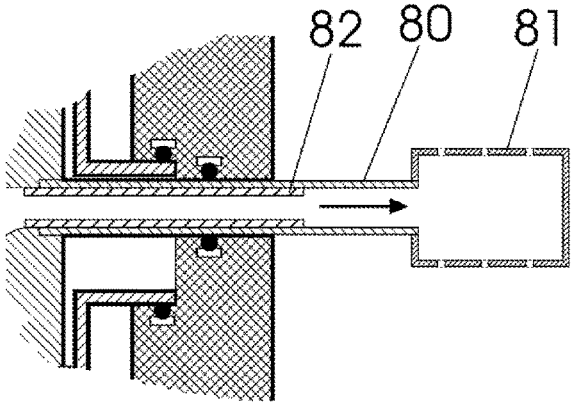
FIG. 7 shows a modification of a rotor shaft

FIG. 7 shows a modification to the engine shown in FIG. 3. The rotor shaft 80 is extended to the outside of the engine. The exhaust gases are expelled through this shaft which includes insulation 82 to protect the engine components from the heat of the gases. A silencer 81 is fitted to the shaft, and it can be seen that this rotates with the shaft.

Figure 8:
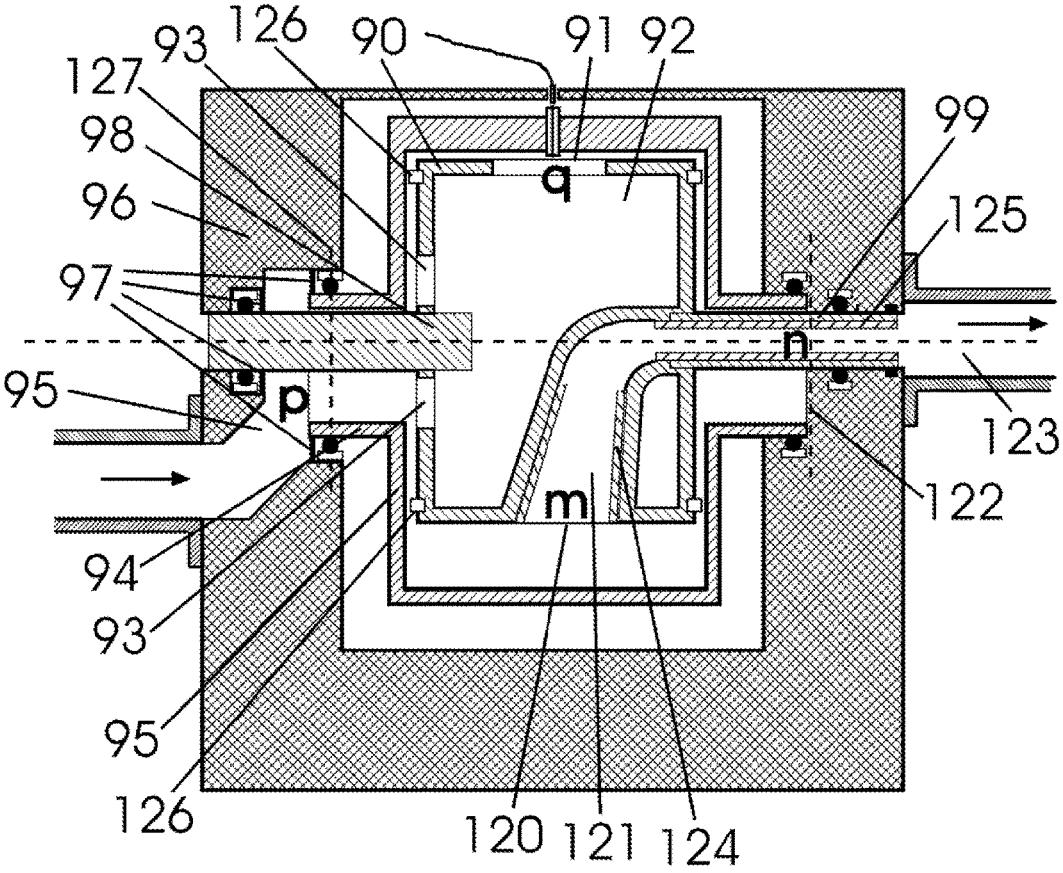
FIG. 8 shows a modification of the cross-section in FIG. 3.

FIG. 8 shows a modification to the engine shown in FIG. 3. The rotor 90 includes a port 91 that opens into a void 92. A passageway for fluid extends from the port, through the void, and through a series of holes 93 into the shaft of the shell 94 which is concentric with the axis of rotation of the shell, to the point where the shell shaft interacts with the support structure 127. The passageway further extends through a duct 95 in the support structure 96, and is sealed by means of seals 97 and 126. A shaft 98 supporting the rotor may be made solid in this embodiment of the invention, or may contain a duct as in previous embodiments. On the other side of the rotor 90 a second port 120 connects to a duct 121 in the rotor with thermal insulation 124, which further extends to a duct in a second rotor shaft 99 also with thermal insulation 125. This forms a continuous passageway m-n from the port 120 to the point 122 where the shaft interacts with the support structure, and further extends to the outlet duct 123. The benefits of this arrangement of the passageway m-n, especially when used for the hot exhaust side of an engine, have been set out above. The inlet passageway is not continuous and unitary and therefore requires more seals to function efficiently, and is in addition more difficult to insulate, however it has the benefit of being of larger cross section than m-n and therefore transfers gases more efficiently. This passageway p-q is used here to admit cold inlet gases into the engine.

Figure 9:
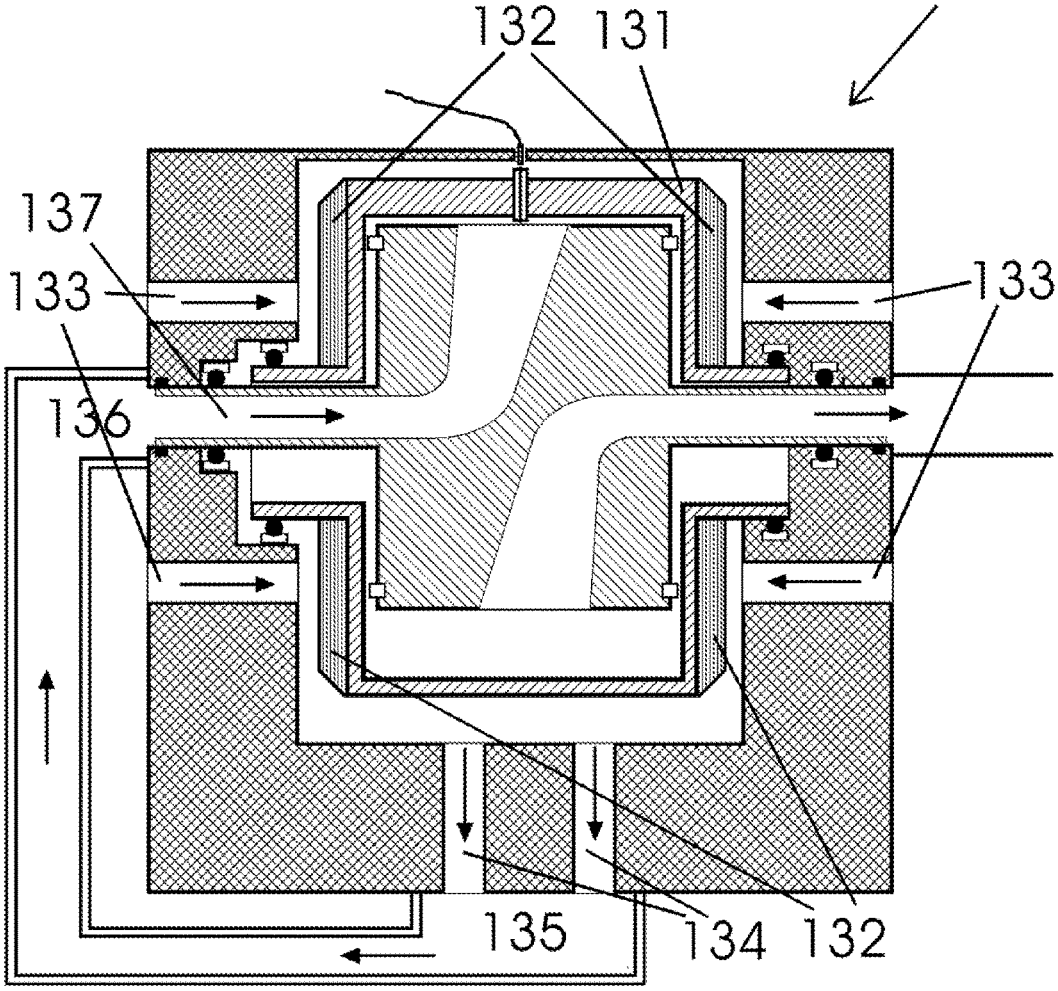
FIG. 9 shows an alternative modification of the cross-section in FIG. 3.

FIG. 9 shows a modification to the engine shown in FIG. 3. The engine 130 has a shell 131 which has a number of fins 132 formed in its external surface. These act as a fan when the shell rotates, drawing air through the vents 133 in the support structure, and blowing the air out through the vents 134. The passage of air across the shell cools the shell, helped by the increased surface area which the fins provide. It can be seen that this is a benefit of rotating the shell of the engine as it removes the need for an external cooling system. Also shown is a modification to the design whereby the air exiting through vents 134 is passed through the duct 135-136 and into the air intake passageway of the engine 137. One skilled in the art will appreciate that this will increase the pressure of the intake air and therefore give the engine a higher power output.

Figure 10:
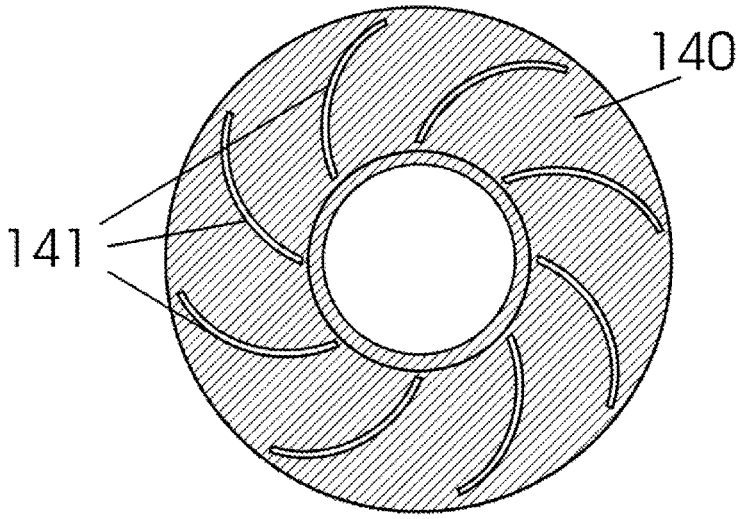
FIG. 10 shows a view of the shell in FIG. 9 along the axis of rotation.

FIG. 10 shows a view of the shell 131 of FIG. 9 viewed along the axis of rotation, and shows the arrangement of curved radial fins 141. There may be provided additional fins formed in the support structure (not shown here) which may interact with the shell fins 141 to provide additional compression of the air.

I claim:

1. A rotary machine comprising:

an inner rotor and an outer shell, the rotor rotating on a first axis and the shell rotating on a second axis parallel to and offset from the first axis, an external support structure which holds the first and second axes in alignment to each other, and wherein the said axes are substantially stationary relative to the support structure, the said shell having two or more sealing points on its inner surface which interact with the outer surface of the rotor to define two or more working chambers between the rotor and the shell, said outer surface including a fluid transfer port, a shaft attached to the rotor and concentric with the first axis of rotation, said shaft containing a duct substantially parallel to the first axis of rotation, which duct is connected to a further duct in the rotor and said further duct connected to the port, the duct and further duct together forming a continuous passageway for fluid from the port to a point where the shaft interacts with the support structure, wherein the passageway is bounded entirely by a plurality of parts, the plurality of parts being joined together such that, during operation of the rotary machine, the plurality of parts remain stationary relative to one another, thereby allowing fluid flow through the passageway throughout operation of the rotary machine and during operation of the rotary machine the passageway rotates about an axis which is substantially stationary relative to the support structure, such that in use the relative rotation of the rotor to the shell causes the working chambers to change in size, and whereby the relative movement of the sealing points across the port controls the transfer of fluid between the port and the working chambers, and wherein the passage is configured such that, during operation of the rotary machine in which the relative rotation of the rotor to the shell is in a first rotational direction, fluid within the passageway flows continuously in a first direction through the passageway between the working chambers and the point where the shaft interacts with the support structure.

2. A rotary machine as in claim 1 in which the outer surface of the rotor is parallel to the first axis.

3. A rotary machine as in claim 1 in which the sealing points are parallel to the second axis.

4. A rotary machine as in claim 1 in which the outer surface of the rotor is substantially in the form of an epitrochoid.

5. A rotary machine as in claim 1 in which the inner surface of the shell is substantially in the form of an epitrochoid.

6. A rotary machine as in claim 1 in which the rotor has one or more lobes, and the number of lobes on the rotor is one less than the number of sealing points on the shell.

7. A rotary machine as in claim 6 in which the rotor surface has two lobes and the shell has three sealing points.

8. A rotary machine as in claim 1 which has:

a second shaft concentric with the axis of rotation of the rotor and attached to the opposite side of the rotor to the first said shaft a second duct within the second shaft, said second duct substantially parallel to the axis of rotation of the second shaft, which second duct is connected to a second further duct in the rotor and said second further duct connected to a second port in the rotor surface said second duct and second further duct together forming a second continuous passageway for fluid from the second port to a point where the second shaft interacts with the support structure, wherein the said second passageway is bounded entirely by a plurality of second parts, the plurality of second parts being joined together such that, during operation of the rotary machine, the plurality of second parts remain stationary relative to one another, thereby allowing fluid flow through the second passageway throughout operation of the rotary machine and during operation of the rotary machine the second passageway rotates about a second axis which is substantially stationary relative to the support structure, such that in use fluid may pass into the machine through the first passageway and exit the machine through the second passageway.

9. A rotary machine as in claim 8, wherein the shaft and second shaft are joined together.

10. A rotary machine as in claim 1 wherein the rotor has a second fluid transfer port which connects to a void within the rotor, said void connecting to a duct located substantially concentrically with the shell, so that in use fluid may be transferred between the second port and a point where the shell interacts with the support structure.

11. A rotary machine as in claim 1 in which the duct in the shaft is connected to a stationary duct by means of a rotary seal concentric to the axis of the shaft.

12. A rotary machine as in claim 1 in which the shell includes a gear ring, said gear ring meshing with a second gear ring attached to a rotor shaft, whereby the rotor and shell are aligned accurately in relation to each other.

13. A rotary machine as in claim 1 in which the sealing points comprise discrete strips.

14. A rotary machine as in claim 13 in which said strips are accessible from outside of the shell.

15. A rotary machine as in claim 1, including two or more fluid transfer ports on the rotor, wherein the position of ports on the rotor is such that the machine functions as a four stoke internal combustion engine.

16. A rotary machine as in claim 1, including two or more fluid transfer ports on the rotor, wherein the position of ports on the rotor is such that the machine functions as a fluid compressor.

17. A rotary machine as in claim 1 wherein a said duct or a said further duct within the rotor shaft is thermally insulated from the rotor shaft.

18. A rotary machine as in claim 1 wherein the said duct is substantially concentric with the axis of rotation of the said shaft.

19. A rotary machine as in claim 1 including fins on the external surface of the shell to provide cooling means to the shell, where the said fin on the external surface of the shell draw air in through a first vent in the support structure, and blow it out through a second vent in the support structure.

20. A rotary machine as in claim 19 where the fins on the shell compress air, said air being ducted to the inlet passageway of the engine.

* * * * *